US006439478B1

(12) United States Patent
King et al.

(10) Patent No.: US 6,439,478 B1
(45) Date of Patent: Aug. 27, 2002

(54) ADAPTER FOR UPRIGHT SPRINKLER WITH ROTATING HEAD

(75) Inventors: Courtney A. King, Ypsilanti, MI (US); Keechang Han, Shanghai (CN)

(73) Assignee: Bird Brain, Inc., Ypsilanti, MI (US)

( * ) Notice: Subject to any disclaimer, the term of this patent is extended or adjusted under 35 U.S.C. 154(b) by 0 days.

(21) Appl. No.: 09/518,758

(22) Filed: Mar. 3, 2000

(51) Int. Cl.[7] ..... B05B 3/06

(52) U.S. Cl. ..... 239/261; 239/264; 239/276; 239/279; 285/354; 285/351; 285/281

(58) Field of Search ..... 239/225.1, 246, 239/251, 261, 264, 276, 265, 273, 279, 280; 285/354, 351, 281

(56) References Cited

U.S. PATENT DOCUMENTS

| | | | |
|---|---|---|---|
| 1,180,526 | A | 4/1916 | Partridge |
| 1,564,934 | A | 12/1925 | Buelna et al. |
| 1,766,514 | A | 6/1930 | Henry |
| 1,780,332 | A | 11/1930 | Brickhill |
| 1,790,732 | A | 2/1931 | Tichava |
| 1,791,222 | A | 2/1931 | Orr |
| 2,323,701 | A | 4/1943 | Barksdale |
| 2,677,577 | A | 5/1954 | Miller |
| 2,731,296 | A | 1/1956 | Griffith |
| 2,946,517 | A | 7/1960 | Jacoby |
| 2,979,272 | A | 4/1961 | Thorrez |
| 3,253,784 | A | 5/1966 | Long et al. |
| 3,326,551 | A | 6/1967 | Clarke |
| 3,357,644 | A | 12/1967 | Penfield et al. |
| 3,565,467 | A | 2/1971 | Haldopoulos et al. |
| 4,948,293 | A | 8/1990 | Smith |
| 5,104,044 | A | 4/1992 | Ratell, Jr. |
| 5,211,337 | A | 5/1993 | Lukez |
| 5,358,180 | A | 10/1994 | Prassas et al. |
| 5,505,380 | A | 4/1996 | Jun |
| 5,769,322 | A | 6/1998 | Smith |
| 6,015,098 | A | 1/2000 | Krueger |
| 6,109,546 | A | 8/2000 | Ormiston |

*Primary Examiner*—Lisa Ann Douglas
(74) *Attorney, Agent, or Firm*—Young & Basile, P.C.

(57) ABSTRACT

An adapter for rotatably connecting a sprinkler head to a water-transporting standpipe having a cylindrical upper end. The adapter includes three parts: a cup-like base adapted to rest on the upper end of the standpipe in sealed fashion, a male stem adapted to rotatably and scalingly seat in the cup-like base, and an oversleeve adapted to fit over the stem and the base and to be locked to the upper end of the standpipe by threaded connection such that a portion of the male stem protrudes from the oversleeve to be secured to the sprinkler head for rotation therewith. The adapter is sealed at several points internally to positively prevent water leaks, and is easily disassembled for replacement, repair, or cleaning, by hand or with simple hand tools, since no permanent connection is required between the adapter, the standpipe, and the sprinkler head.

23 Claims, 5 Drawing Sheets

ADAPTER FOR UPRIGHT SPRINKLER WITH ROTATING HEAD

FIELD OF THE INVENTION

The invention is in the field of lawn sprinklers, and in particular a class of sprinklers of a lawn-decorating type in which a sculpture-like sprinkler head is rotatably mounted at the top of a vertical stand pipe connected to a water supply.

BACKGROUND OF THE INVENTION

There is a class of lawn sprinklers known for their sculpture-like ornamentation of lawns. These sprinklers generally comprise a sprinkler head made from hollow metal tubing bent or formed into graceful, artistic designs. The sprinkler head is mounted on the end of an upright standpipe, usually several feet in height. The standpipe is supported on a base secured to the lawn, and connected to a water supply through a garden hose.

The decorative sprinkler heads are intended to rotate, both to provide uniform coverage and often to create a decorative spray effect. The rotation is created by the force of water exiting spray holes perforating the hollow tubing of the sprinkler head.

It is accordingly necessary to provide a rotatable connection between the sprinkler head and the upper end of the standpipe. This connection is usually in the form of a multi-part bushing which rotatably connects the sprinkler head to the standpipe and provides a passage for water from the standpipe to the sprinkler head. Such multi-part bushings typically suffer from two problems: they leak, and they do not provide a sufficiently strong connection between the sprinkler head and the standpipe. Another problem encountered with some of these bushings is the need to braze or weld them to the standpipe.

SUMMARY OF THE INVENTION

The invention is a three-part adapter bushing for connecting a decorative, tube-type sprinkler head to the upper end of a vertical standpipe, in rotating manner, without leaks, without tendencies to loosen, and without requiring a permanent weld. The first part is a cup-like base which rests on the upper annular edge of the standpipe. The second part comprises a stem having a lower end which seats in rotatable, sealed fashion inside the cup-like base, and an upper end adapted to be secured to the sprinkler head.

The third part comprises an oversleeve which fits over both the cup and the stem rotatably contained in the cup to be removably secured to the upper end of the standpipe, preferably by threaded connection.

The cup-like base is axially sealed with respect to the upper, annular edge of the standpipe. The lower end of the stem is radially sealed with respect to the cup. As the oversleeve is threaded down over the cup/stem combination, the oversleeve engages the radial seal between the lower end of the stem at the cup-like base, and further places the axial seal between the cup-like base with the upper end of the standpipe under compression.

The upper end of the stem protrudes from the oversleeve when the over sleeve is secured to the standpipe, for connection to the sprinkler head. In a preferred form, the upper end of the oversleeve provides a rotatable bearing surface for a portion of the sprinkler inserted over the upper end of the stem. Accordingly, when the sprinkler head is secured to the upper end of the stem, in preferred form by a set screw engaging a groove in the upper end of the stem, the stem rotates with the sprinkler head on the cup-like base on the standpipe inside the over sleeve, without leaking, and without working loose.

These and other features and advantages of the invention will become apparent upon further reading of the specification in light of the accompanying drawings.

DETAILED DESCRIPTION OF THE ILLUSTRATED EMBODIMENT

Figure 1:
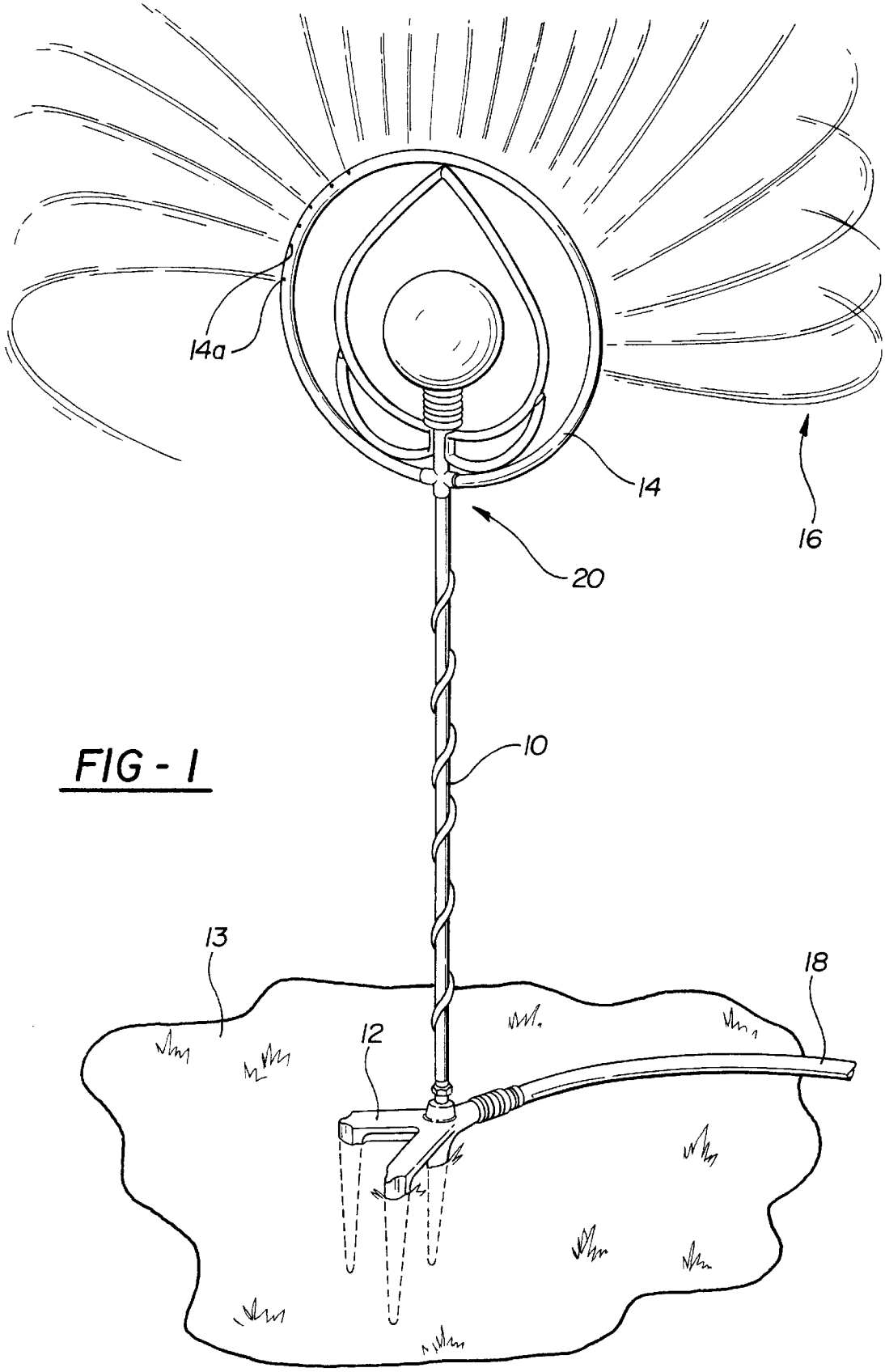
FIG. 1 is a perspective view of a decorative upright sprinkler having a rotating, sculpture-like head supported on a vertical standpipe.

Referring to FIG. 1, a decorative upright sprinkler of a generally known type is illustrated as comprising a standpipe 10 secured to a base 12 fastened in lawn 13. A sculpture-like decorative sprinkler head 14 is rotatably mounted on the upper end of standpipe 10, caused to rotate by the force of water exiting holes 14*a* in a spray pattern 16.

Water is applied to sprinkler head 14 through hollow standpipe 10, which is in fluid communication with garden hose 18 through base 12. Base 12 is an invention in its own right, and is the subject of co-pending applications assigned to the assigned of the present application.

The present invention is hidden from view in FIG. 1, but its position is generally denoted by reference numeral 20 at the rotating junction of sprinkler head 14 with the upper end of standpipe 10. The invention is an adapter or connector for positively securing sprinkler head 14 to the upper end of standpipe 10 in a rotatable manner, removable, durable, leakproof, and not susceptible to working loose.

Figure 2A:
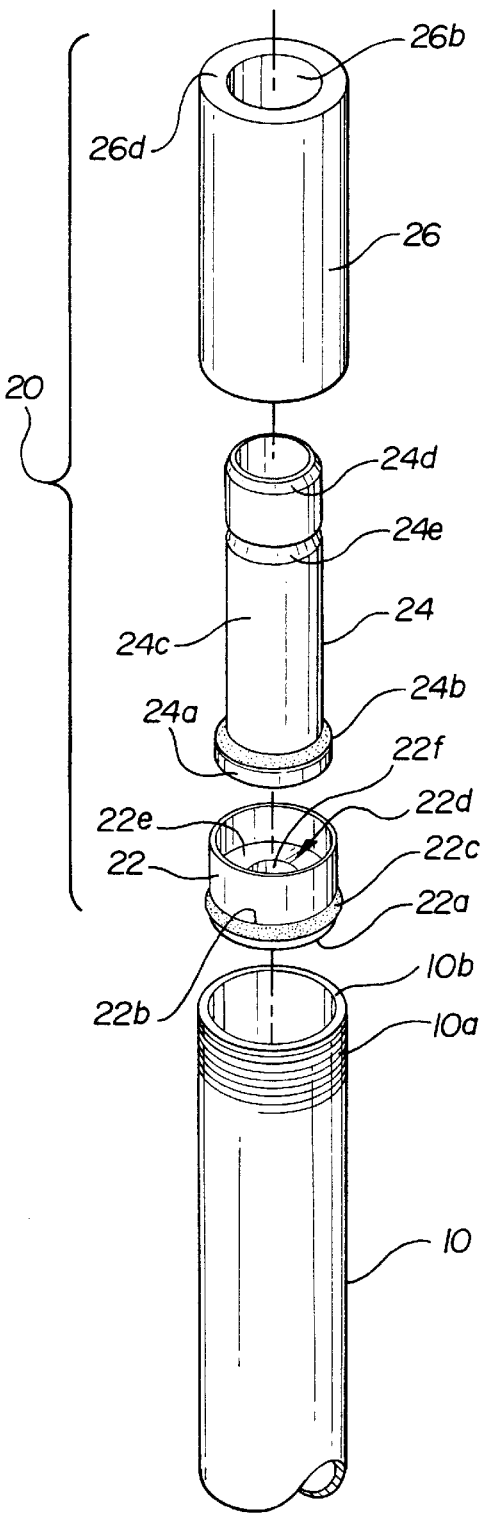
FIG. 2A is an exploded view, from above, of a three-part adapter according to the present invention in relationship to the upper end of the sprinkler standpipe.
Figure 2B:
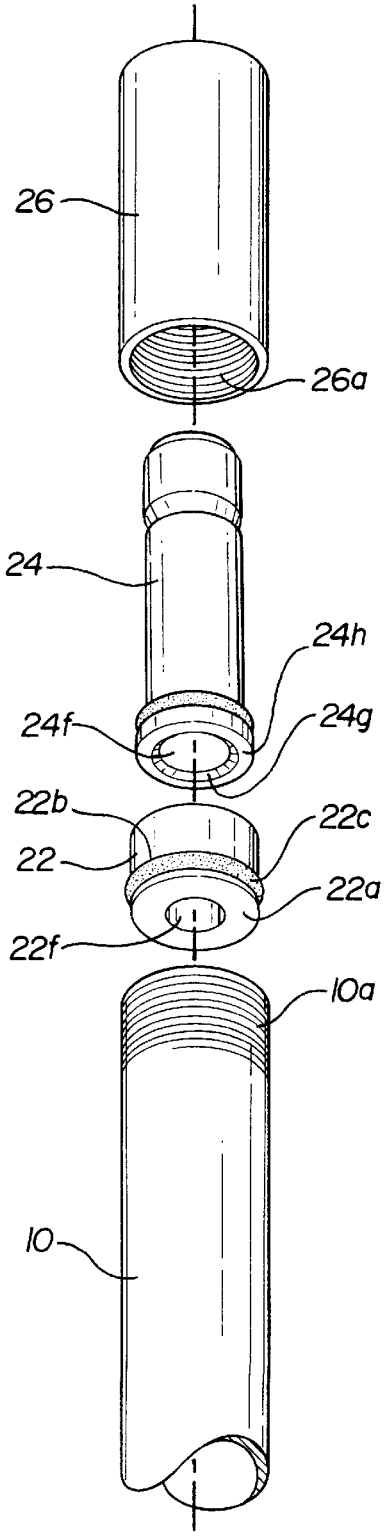
FIG. 2B is a perspective view, from below, of the adapter of FIG. 2A.

Referring next to FIGS. 2A and 2B, the inventive adapter 20 is illustrated in exploded, disassembled view in alignment with the upper end 10*a* of standpipe 10.

Adapter 20 comprises a three-piece assembly comprising a cup-like base 22, a stem 24, and an oversleeve 26, all three of which are preferably machined from a durable, corrosion resistant material such as brass or possibly stainless steel or plastic. Brass is preferred. In the illustrated embodiment standpipe 10 is made from copper tubing, although other metals and plastic are possible substitutes.

Figure 3A:
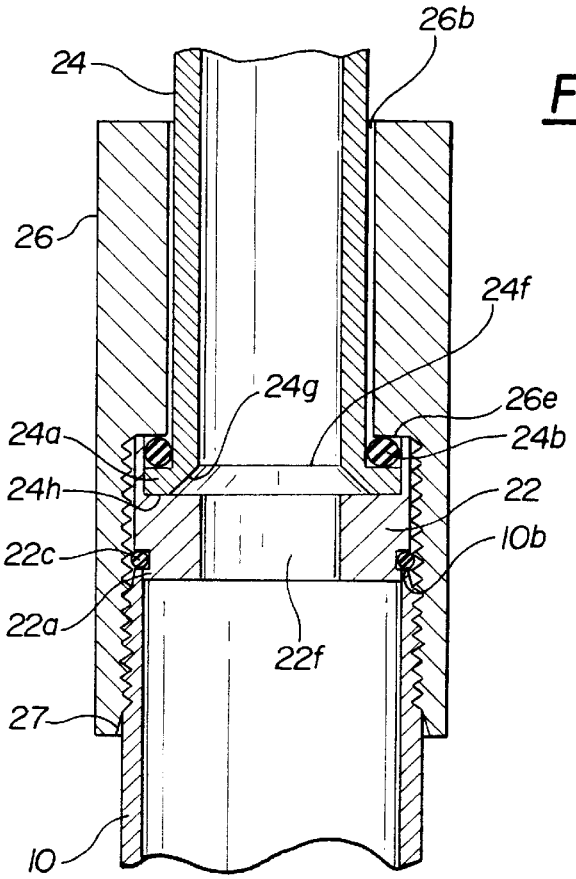
FIG. 3A is a side elevational view, in section, of the upper end of the standpipe with the inventive adapter of FIGS. 2A–2B secured thereto.
Figure 3B:
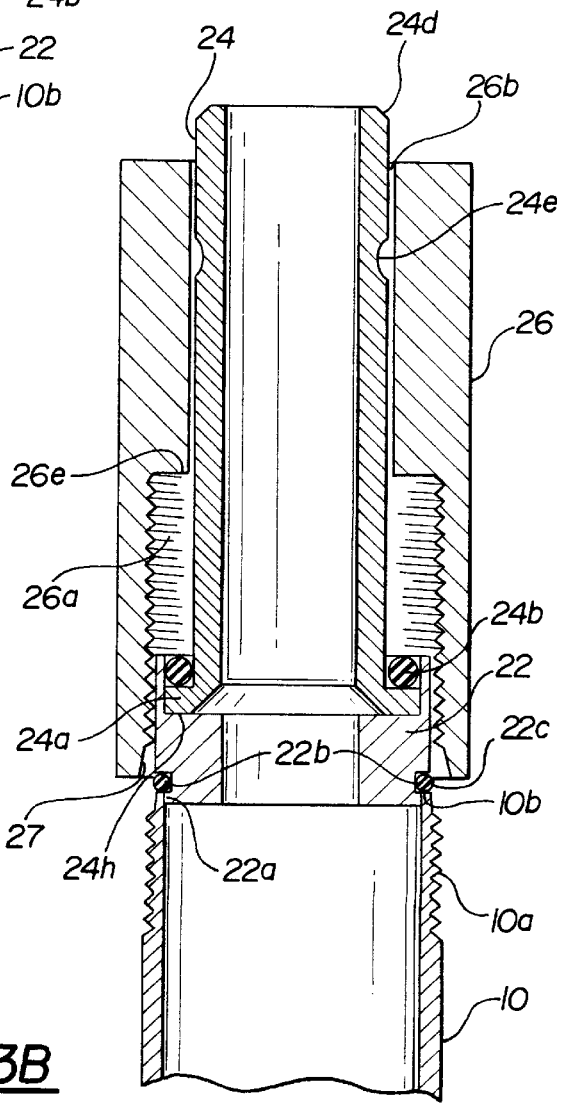
FIG. 3B is a side elevational view, in section, of the structure of FIG. 3A, but with an oversleeve portion removed from the standpipe.

Cup-like base 22 includes a cylindrical bottom plug portion 22*a* having an outside diameter sized to fit closely inside the upper end of standpipe 10 as best shown in the section views of FIGS. 3A and 3B. The larger diameter body of base 22 forms an overhanging shoulder above plug portion 22*a*, defining a groove or seat 22*b* between them for annular seal 22*c*. Seal 22*c*, illustrated as a rubber O-ring, rests against the upper-edge 10*b* of the standpipe, pressed there against by the body of cup 22.

Base 22 includes a cylindrical cup-like interior 22*d* machined or otherwise formed in its upper end, defining an inner bearing surface 22*e* surrounding a water passage 22*f*.

Male stem 24 has a cylindrical bottom flange 24*a* whose diameter is greater than plug portion 24*c* to define a seat for a seal 24*b*. The outside diameter of bottom flange 24*a* is adapted to fit closely into the cylindrical inner diameter of base 22, while still being free to rotate on bearing surface 22*e*. Seal 24*b*, having a larger diameter than flange 24*a*, is radially compressed inside the interior 22*d* of base 22, forming a radial seal between stem 24 and the interior side wall of cup 22 as best shown in FIGS. 3A and 3B.

The upper end of male stem 24 is preferably provided with a chamfer or bevel 24*d*, and further includes a locking groove 24*e* adapted to receive a mechanical locking fastener from the sprinkler head, for example a set screw 36.

The lower end of male stem 24 includes a chamfered opening 24*g* for water passage 24*f*, surrounded by a flat, annular bearing surface 24*h* adapted to rotate smoothly on bearing surface 22*e* inside cup 22.

The final piece in the assembly is an oversleeve 26 having a lower threaded bore 26*a* sized to fit over both stem 24 and base 22, and further to be threadably mated with the threaded upper end 10*a* of standpipe 10. Threaded lower bore 26*a* extends partway into oversleeve 26, and terminates at an interior shoulder 26*e* (FIGS. 3A and 3B) at the junction with a smaller diameter upper bore 26*b*. Upper bore 26*b* is sized to admit plug portion 24*c* of stem 24 therethrough with a freely rotatably fit between them, with the upper end of plug portion 24*c* extending from the oversleeve to expose set screw groove 24*e* and chamfered tip 24*d*.

Referring now specifically to FIGS. 3A and 3B, adapter 20 is assembled on the upper end of standpipe 10 as follows. Cup-like base 22 is seated axially on the upper end of the standpipe, with its bottom plug portion 22*a* inserted snugly in the bore of the standpipe, and with O-ring seal 22*c* seated against upper edge 10*b* of the standpipe.

Male stem 24 may be inserted separately into base 22 at this point, or may have previously been assembled to base 22, in the following manner. Bottom flange 24*a* of the male stem is inserted in the cylindrical interior volume 22*d* of base 22, with its lower bearing surface 24*h* resting against inner bearing surface 22*e*, and with O-ring seal 24*b* radially compressed between the interior sidewall of cup interior 22*d* and stem 24. It will be noted from FIGS. 3A and 3B that the lower opening 24*g* for the water passage in male stem 24 has a chamfered diameter greater than the diameter of water passage 22*f* through base 22, while the remainder of passage 24*f* through stem 24 is preferably equal to the diameter of passage 22*f* in the base.

Next, oversleeve 26 slides over plug portion 24*c* of male stem 24, over cup-like base 22, and into threaded engagement with threaded upper end 10*a* of standpipe 10, where it is threaded axially down into locking engagement with the standpipe such that inner shoulder 26*e* axially compresses O-ring seal 24*b*.

It will be apparent from FIG. 3A that the resulting connection between standpipe 10 and adapter 20 is both axially and radially locked and sealed to the standpipe and further provides a rotatable connecting piece 24 for the sprinkler head. The connection is easily disassembled by hand. The use of internal O-ring seals allows for simple repair/replacement not possible with welded or brazed confections.

Another preferred feature of the invention is the interruption of the threaded portion 26*a* of the lower bore in oversleeve 26 to leave a short (e.g., an eighth of an inch) unthreaded portion 27 at the lowermost end for a strong, solid, annular band of material against the standpipe wall below threaded portion 10*a*. Similarly, the uppermost end of standpipe 10 above threaded portion 10*a* is preferably left smooth and unthreaded, for a thicker band of wall material to reinforce the connection with cup-like adapter base 22, and to provide a wider, flatter annular sealing surface for seal 22*c*.

Figure 4:
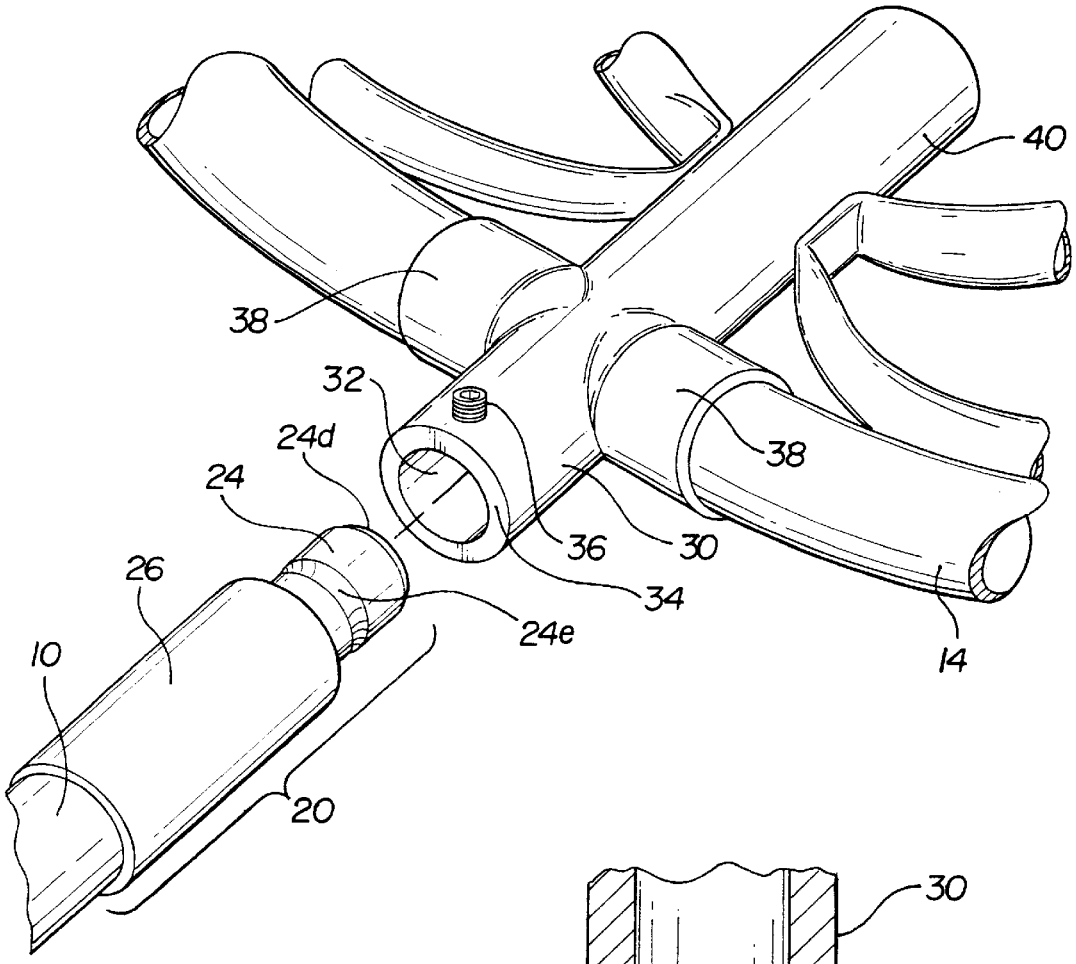
FIG. 4 is a perspective view of the standpipe equipped with the inventive adapter of FIG. 2A being connected to the base of the sprinkler head illustrated in FIG. 1.
Figure 5:
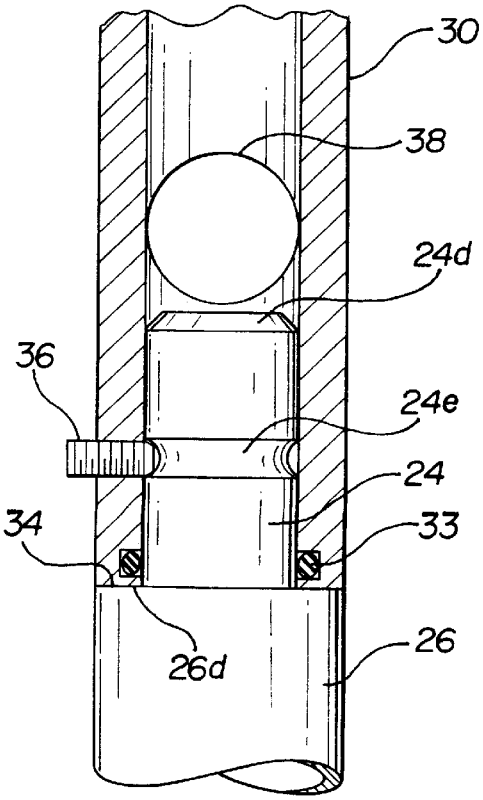
FIG. 5 is a side elevational view, partly in section, of the adapter and sprinkler head of FIG. 4 assembled, with the sprinkler head secured to the upper stem portion of the adapter via set screw and further illustrating a rotatable seal between the sprinkler head and the upper end of the adapter.

Referring next to FIGS. 4 and 5, adapter 20 assembled as shown in FIG. 3A on the end of standpipe 10 is shown in operative connection with a mating receptacle 30 on sprinkler 14, in the illustrated embodiment in the form of a preferred T-shaped adapter having an inlet 32, two outlets 38, and an upper end 40 which in the illustrated embodiment of FIG. 4 defines a blind base socket separated from the inlet and outlets by an internal partition. Receptacle 30 may be formed from metal or plastic, and in a preferred form is made from brass or copper. Inlet 32 has a diameter sized to receive the upper end of male stem 24 in a close, rotatable fit with an annular bearing surface 34 on the receptacle seated against annular bearing surface 26*d* on the upper end of oversleeve 26. Chamfered upper end 24*d* of stem 24 guides the insertion of stem 24 into inlet 32. Once receptacle 30 and adapter 20 are fully axially assembled as shown in FIG. 5, a mechanical fastener such as the exemplary set screw 36 rotationally and axially locks receptacle 30 and sprinkler 14 to stem 24, such that rotation of sprinkler head 14 translates into rotation of stem 24 in adapter 20.

FIG. 5 illustrates a preferred additional seal 33 comprising an O-ring set in a groove in the inner sidewall of inlet 32 below set screw 36.

Water from standpipe 10 travels through adapter 20 into receptacle 30 and exits through outlets 38 to the hollow tubing of sprinkler head 14. The multiple seals, both internally in adapter 20 and between receptacle 30 and male stem 24, positively prevent leaks between standpipe and sprinkler. Unlike many prior art arrangements, the adapter 20 and sprinkler 14 can be removed and fully disassembled by hand or with simple hand tools, since they do not require any permanent connection such as adhesive, brazing or welding.

Figure 5A:
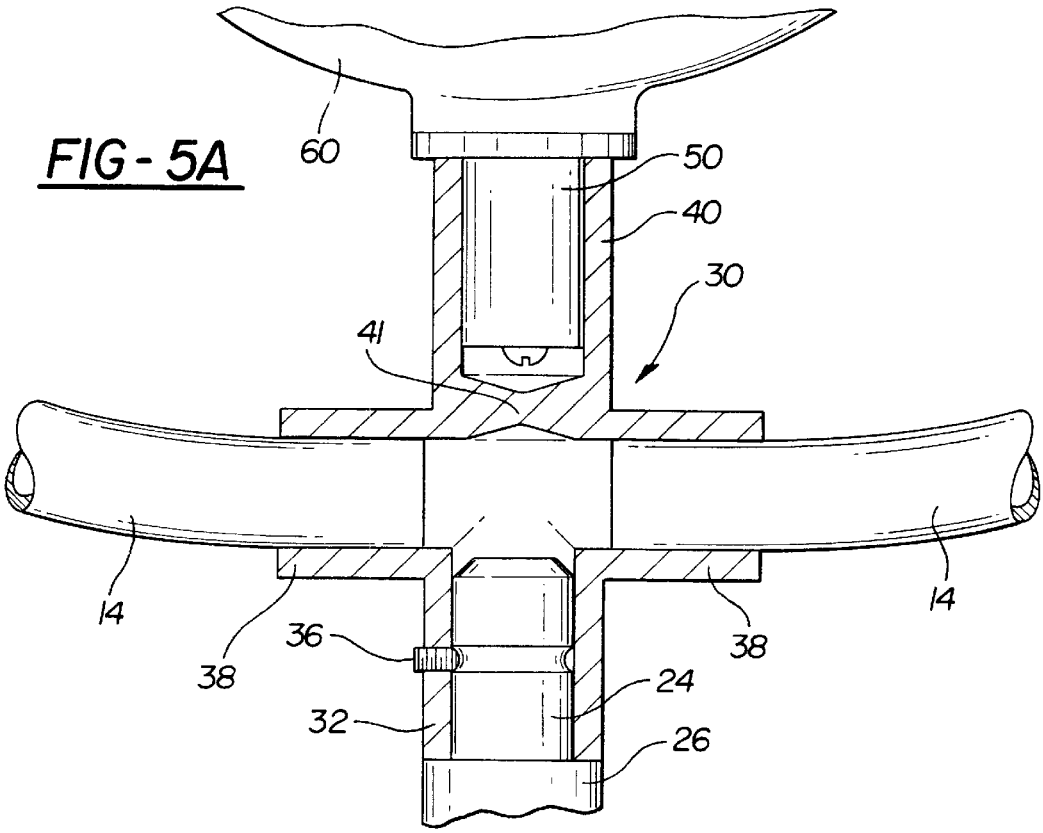
FIG. 5A is a section view of the connection between the inventive adapter and the base of the sprinkler head from FIG. 4.

FIG. 5A illustrates the preferred sprinkler base fitting 30 in section. Fitting 30 is made from a single piece of metal, for example brass, with inlet end 32 sized inside and out to form a rotatable extension of oversleeve 26 mechanically secured to male stem 24. Because male stem 24 is in turn axially locked by oversleeve 26 to the standpipe (FIG. 4), sprinkler head 14 is securely and rotatably locked to the standpipe, able to withstand high water pressure without being blown off as in other known connectors used for sprinklers of the type illustrated in FIG. 1.

Figure 6:
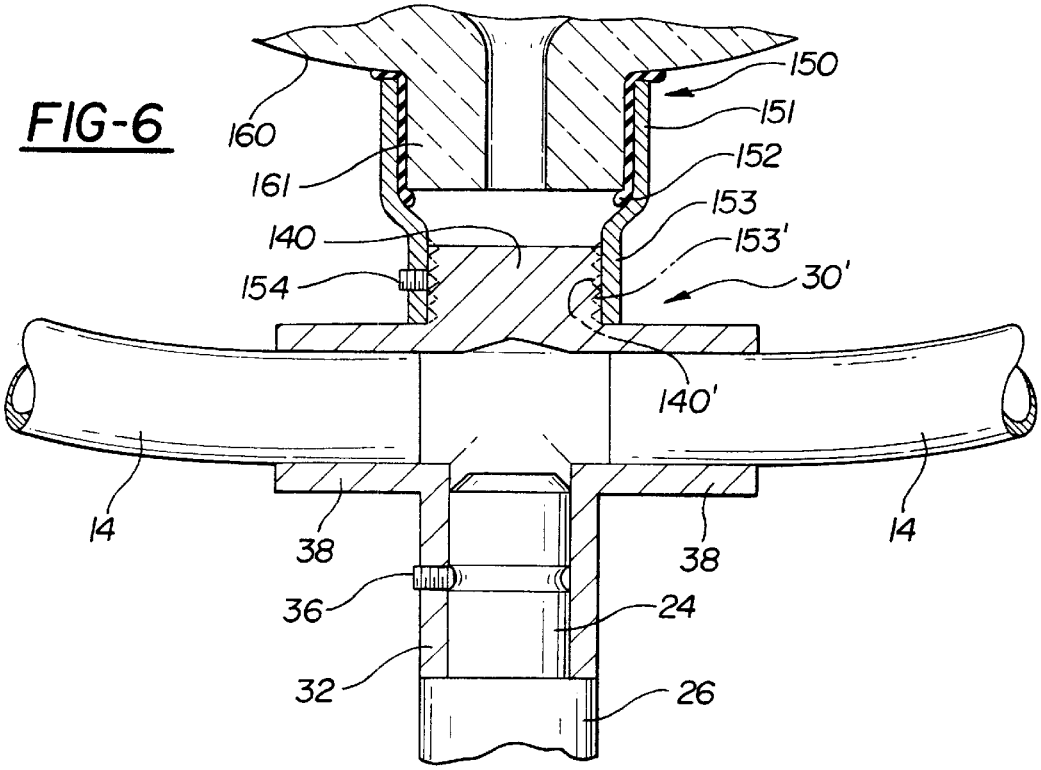
FIG. 6 illustrates an alternate sprinkler head base connected to the adapter as in FIG. 5A.

Upper end 40 of fitting 30 defines a tubular socket separated from the T-shaped inlet/outlet portion by an internal wall 41. In the illustrated embodiment of FIG. 5A, socket end 40 receives a mounting adapter 50 from a decorative glass gazing ball 60 best illustrated in FIG. 1. FIG. 6 illustrates one possible alternative to socket 40, in the form of a solid cylindrical mounting pedestal 140 receiving an alternate mounting adapter 150 connected to a decorative glass ball or bulb 60. Adapter 150 is a metal collar or sleeve having an upper end 151 attached with adhesive 152 to the cylindrical stem 161 of bulb 160. The lower end 153 of adapter 150 fits snugly over pedestal 140 and is mechanically secured to the pedestal, for example with a set screw 154. The direct metal to-glass adapter 150 with its mechanical attachment to pedestal 140 is believed to be a novel and patentable invention in itself An alternate manner for securing fitting 30' to stem 140 is with a threaded connection shown in phantom at 153', 140', either in place of or in addition to set screw 36. Other known methods of removable mechanical connection can also be used.

It will be understood that the foregoing description of an illustrated embodiment is given by way of preferred illustration, and is not intended to limit the scope of the invention beyond that defined in the claims below. It will be apparent to those skilled in the art that many minor modifications to the materials, dimensions, and geometries of the inventive adapter and its connection to sprinkler 14 can be made without departing from the scope of the invention, and will be obvious now that a particular example of the invention has been disclosed. Accordingly, we claim:

What is claimed is:

1. An adapter for connecting a sprinkler head in rotating fashion to a standpipe having a cylindrical upper end, comprising:

a cup-like base having an annular seal portion adapted to rest on the cylindrical upper end of the standpipe in an axial sealing fit, an axial water passage, and an upwardly-opening cylindrical bore defining an annular axial bearing surface with a cylindrical radial sealing surface;

a cylindrical male stem having a lower sealed portion inserted in the cylindrical bore and sized for rotation therein on the axial bearing surface with a seal against the radial sealing surface, and an upper end adapted for connection to a sprinkler head; and, an oversleeve having a bore sized to fit over the male stem and cup-like base and adapted to engage the upper end of the standpipe with an axial locking connection.

2. The adapter of claim 1, wherein the oversleeve bore is provided with threads on a lower portion thereof adapted for a threaded connection to mating threads on the standpipe.

3. The adapter of claim 2, wherein a lowermost portion of the oversleeve bore is unthreaded, and has a diameter adapted to smoothly engage an unthreaded sidewall portion of the standpipe below the mating threads on the standpipe.

4. The adapter of claim 1, wherein the oversleeve bore has a lower, larger diameter portion adapted to fit over an outer diameter of the standpipe, and an upper, smaller diameter portion engaging the outer surface of the male stem, and an annular shoulder axially engaging the lower sealed portion of the male stem in the cup-like base.

5. The adapter of claim 4, wherein an upper end of the male stem extends above an upper end of the oversleeve when the annular shoulder of the oversleeve is in axial engagement with the lower sealed portion of the male stem.

6. The adapter of claim 5, wherein the upper end of the male stem includes an annular groove adapted to receive a set screw.

7. The adapter of claim 1, wherein the cup-like base has a lower plug portion adapted to extend partway into the standpipe in contact with an inside wall of the upper end of the standpipe, and further wherein the base has an annular seal above the lower plug portion, the annular seal being adapted to axially engage an upper annular edge of the standpipe when the lower plug portion is in the standpipe.

8. The adapter of claim 1, wherein the male stem has a lower end terminating in an annular shoulder, the annular shoulder supporting an annular seal on an upper surface thereof, the annular shoulder forming an annular bearing surface on the lower surface thereof.

9. An adapter for connecting a sprinkler head in rotating fashion to a standpipe having a cylindrical upper end, comprising:

a cup-like base adapted to be seated in a sealing fit on an upper annular edge of the standpipe;

a cylindrical stem having a first lower end rotatably seated in the cup-like base, and a second upper end adapted for connection to a sprinkler head;

an oversleeve fitting over the cup-like base and the cylindrical stem and adapted to be locked to an upper end of the standpipe with the upper end of the cylindrical stem rotatably protruding through the upper end of the oversleeve.

10. The adapter of claim 9, wherein the cup-like base includes an annular seal adapted to be axially sealed against an upper annular edge of the standpipe.

11. The adapter of claim 10, wherein the first lower end of the cylindrical stem includes an annular seal radially engaging a portion of the cup-like base for a rotating seal against the base.

12. The adapter of claim 11, wherein the oversleeve includes an annular seal on a lower interior portion of an internal bore formed therein adapted to radially engage an outer wall of the standpipe.

13. The adapter of claim 9, further including a water fitting secured to the upper end of the cylindrical stem to rotate with the cylindrical stem and conduct water to a sprinkler head.

14. The adapter of claim 13, wherein the water fitting is a T-fitting with an inlet secured to the cylindrical stem and two outlets adapted to receive water conducting portions of a sprinkler head.

15. The adapter of claim 14, wherein the T-fitting includes an upper end adapted to receive an ornament.

16. The adapter of claim 13, wherein the water fitting includes an integral sleeve member fitted over the cylindrical stem and mechanically locked thereto, the integral sleeve member further rotatably mating with an upper end of the oversleeve so as to form a rotatable extension thereof.

17. A rotatable connection between a sprinkler head and the upper end of a water-transporting standpipe, comprising:

a water fitting on the sprinkler head communicating with water flow passages in the sprinkler head;

a water-transporting standpipe adapted to be disposed in an upright, substantially vertical orientation, the standpipe having an upper cylindrical end with threads formed on the outer surface thereof;

an adapter comprising a cup-like base having an annular seal portion resting on an annular upper edge of the standpipe with an axial sealing fit, a male stem having a lower seal portion rotatably mounted in the cup-like base with a radial, rotatable seal with the base, and an oversleeve having a cylindrical bore sized to fit over the male stem and cup-like base, and having a lower threaded portion in the bore threadably engaging the threads formed on the outer surface of the upper end of the standpipe, the oversleeve bore having an internal portion axially engaging the cup-like base in the lower sealed portion of the male stem to axially secure the male stem in the cup-like base and to further secure the cup-like base against the upper annular edge of the standpipe such that the male stem is rotatably retained in the cup-like base inside the oversleeve, and further such that an upper end of the male stem extends above the oversleeve and is secured to the water fitting of the sprinkler head such that the sprinkler head is rotatable with the stem.

18. The rotatable connection of claim 17, wherein the water fitting comprises a cylindrical sleeve member fitted over the cylindrical stem and mechanically locked thereto.

19. The rotatable connection of claim 18, wherein the cylindrical sleeve member rotatably mates with an upper end of the oversleeve so as to form a rotatable extension thereof.

20. An adapter for connecting a sprinkler head in rotating fashion to a standpipe having a cylindrical upper end, comprising:

a cup-like base having an annular seal portion adapted to rest on the cylindrical upper end of the standpipe in an axial sealing fit, an axial water passage, and an upwardly-opening cylindrical bore defining an annular axial bearing surface with a cylindrical radial sealing surface;

a cylindrical male stem having a lower sealed portion inserted in the cylindrical bore and sized for rotation therein on the axial bearing surface with a seal against the radical sealing surface, and an upper end adapted for connection to a sprinkler head;

an oversleeve having a bore sized to fit over the male stem and cup-like base and adapted to engage the upper end of the standpipe with an axial locking connection; and wherein the oversleeve bore has a lower, larger diameter diameter portion adapted to fit over an outer diameter of the standpipe, and an upper, smaller diameter portion engaging the outer surface of the male stem, and an annular shoulder axially engaging the lower sealed portion of the male stem in the cup-like base.

21. The adapter of claim 20, wherein an upper end of the male stem extends above an upper end of the oversleeve when the annular shoulder of the oversleeve is in axial engagement with the lower sealed portion of the male stem.

22. The adapter of claim 21, wherein the upper end of the male stem includes an annular groove adapted to receive a set screw.

23. An adapter for connecting a sprinkler head in rotating fashion to a standpipe having a cylindrical upper end, comprising:

a cup-like base having an annular seal portion adapted to rest on the cylindrical upper end of the standpipe in an axial sealing fit, an axial water passage, and an upwardly-opening cylindrical bore defining an annular axial bearing surface with a cylindrical radial sealing surface;

a cylindrical male stem having a lower sealed portion inserted in the cylindrical bore and sized for rotation therein on the axial bearing surface with a sealing against the radical sealing surface, and an upper end adapted for connection to a sprinkler head;

an oversleeve having a bore sized to fit over the male stem and cup-like base and adapted to engage the upper end of the standpipe with an axial locking connection; and wherein the cup-like base has a lower plug portion adapted to extend partway into the standpipe in contact with an inside wall of the upper end of the standpipe, and further wherein the base has an annular seal above the lower plug portion, the annular seal being adapted to axially engage an upper anngular edge of the standpipe when the lower plug portion is in the standpipe.

* * * * *

UNITED STATES PATENT AND TRADEMARK OFFICE

CERTIFICATE OF CORRECTION

PATENT NO. : 6,439,478 B1
DATED : August 27, 2002
INVENTOR(S) : King

It is certified that error appears in the above-identified patent and that said Letters Patent is hereby corrected as shown below:

Column 2,
Line 51, delete “assigned” and insert -- assignee --;

Column 7,
Line 30, delete “radical” and insert -- radial --;

Column 8,
Line 23, delete “sealing” and insert -- seal --;
Line 24, delete “radical” and insert -- radial --;
Line 36, delete “anngular” and insert -- annular --;

Signed and Sealed this

Thirty-first Day of December, 2002

JAMES E. ROGAN
*Director of the United States Patent and Trademark Office*